United States Patent [19]

Jackson

[11] Patent Number: 4,752,091

[45] Date of Patent: Jun. 21, 1988

[54] LATCH WITH AUTOMATIC CLOSING FEATURE

[75] Inventor: Frank T. Jackson, Riverside, Calif.

[73] Assignee: Hartwell Corporation, Placentia, Calif.

[21] Appl. No.: 940,521

[22] Filed: Dec. 10, 1986

[51] Int. Cl.[4] ..... E05C 3/14

[52] U.S. Cl. ..... 292/126; 292/191

[58] Field of Search ..... 292/191, 192, 99, 216, 292/124, 126, 336, 51, 198, 48

[56] References Cited

U.S. PATENT DOCUMENTS 2,693,099 11/1954 Vigmostad ..... 292/48 X 2,790,666 4/1957 Vanderfeld ..... 292/336 X

*Primary Examiner*—Richard E. Moore

*Attorney, Agent, or Firm*—Lyon & Lyon

[57] ABSTRACT

A latch mechanism with a self-latching feature comprising a pin slideably mounted to one body and a handle pivotally mounted to a second body having a latching portion thereon for engagement with the pin. A cam member is positioned to pivot the handle to a disengaged position under action of the pin.

2 Claims, 2 Drawing Sheets

LATCH WITH AUTOMATIC CLOSING FEATURE

BACKGROUND OF THE INVENTION

The field of the present invention is mechanisms for latching two bodies.

Apparatus for latching together bodies must often be capable of withstanding great loads yet must be easily operable. This is especially critical where more than one latch mechanism is required to adequately secure the bodies. Often the operator must perform a series of steps requiring manipulation of one or more control members in order to complete the latching or unlatching sequence. It would be desirable if two bodies could simply be placed together and latched by manipulating a single control member.

SUMMARY OF THE INVENTION

The present invention is directed to a mechanism with a self-latching feature for latching two bodies. A latching member associated with one body is configured to retain a latching pin associated with a second body. A cam mechanism is provided to maintain the latching member in an unlatching position during insertion of the latching pin. The cam mechanism also can maintain the latching member in the unlatching position once withdrawal of the latching pin is initiated.

DETAILED DESCRIPTION OF THE PREFERRED EMBODIMENT

Turning to the Figures, a sliding member or latching pin 12 having a forward tip portion 14 and a latching portion 15 is slideably mounted to a first latched body 16 by any suitable mounting means. The latching portion 15 has substantially perpendicular walls to the centerline of the latching pin 12.

Figure 1:
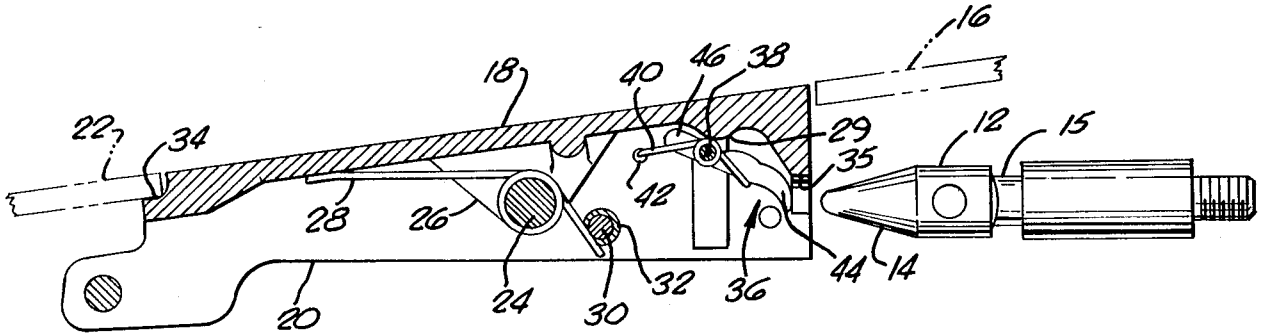
FIG. 1 shows a cross-sectional view of a latch taken roughly through a centerline thereof and a full side view of a pin constructed in accordance with the present invention. The pin is shown in an unlatched position.
Figure 2:
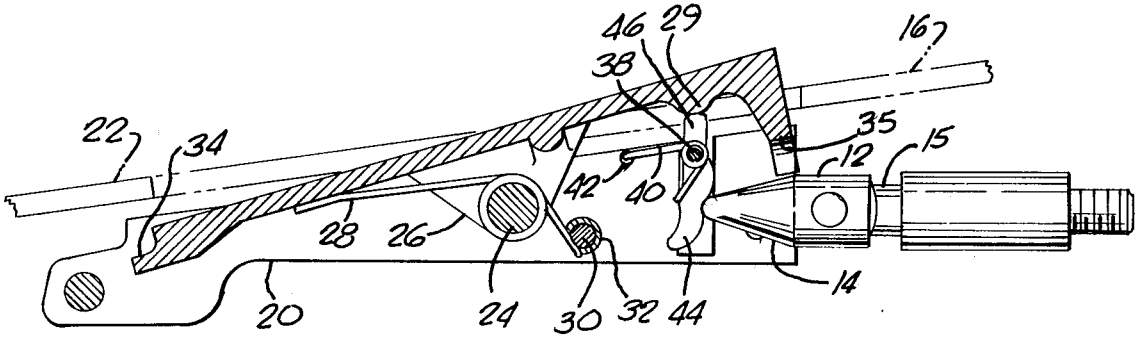
FIG. 2 is similar to FIG. 1 but shows the latch and pin in an intermediate position.

A latching member or handle 18 is pivotally mounted to a support assembly 20 which in turn is fixedly mounted to a second latched body 22. The handle 18 is pivotally mounted to the support member 20 by a handle support pin 24. The pin 24 extends through the support member 20 and the lugs 26 to provide the pivotal connection between the handle member 18 and the support member 20. The handle member 18 is pivotable from a latching position as shown in FIG. 1 to an unlatching position as shown in FIG. 2. The handle member 18 is resiliently biased by a spring 28 which is mounted on the handle pin 24. The spring 28 extends between the handle member 18 and a spring support pin 30 having a bushing 32 thereon. The spring support pin 30 extends through the support member 20 and is positioned so as to provide sufficient preload on the spring 28. To limit the rotation of the handle 18 under the force of the spring 28, the handle 18 includes a step 34 positioned at one end thereof to contact a portion of the second body 22. An engagement portion 35 extends from the handle member 18 and has substantially perpendicular surfaces to the axis of the latching pin 12 when it is engaged therewith.

Also mounted on the support member 20 is a cam member 36. The cam member 36 is pivotally mounted about a cam member support pin 38 extending through the support member 20. The cam member 36 is resiliently biased by a spring 40 which is mounted on the pin 38 and extends from the cam member to holes 42 in the support member 20. The cam member 36 has a first end portion 44 configured for cooperation with the pin 12 at the tip 14 thereof. The cam member 36 also includes a second end portion 46 disposed on the other side of the pin 38 for pivoting the handle member 18 by camming action at a protuberance or cam follower surface 29 thereon.

Figure 3:
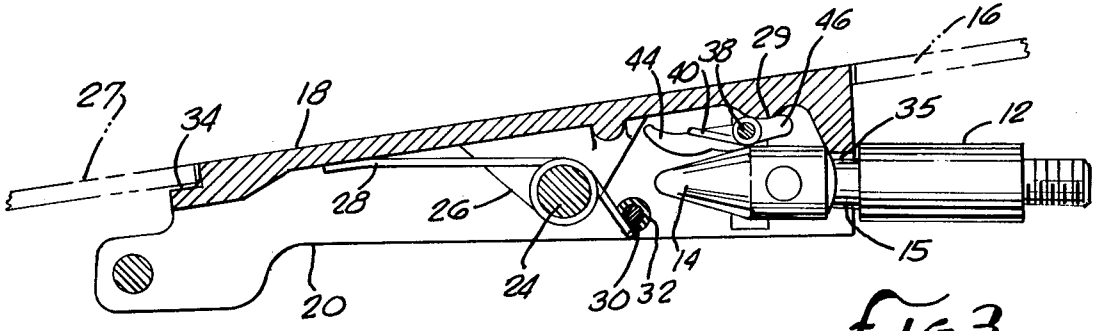
FIG. 3 is similar to FIG. 1 but shows the latch and pin in the latched position.
Figure 4:
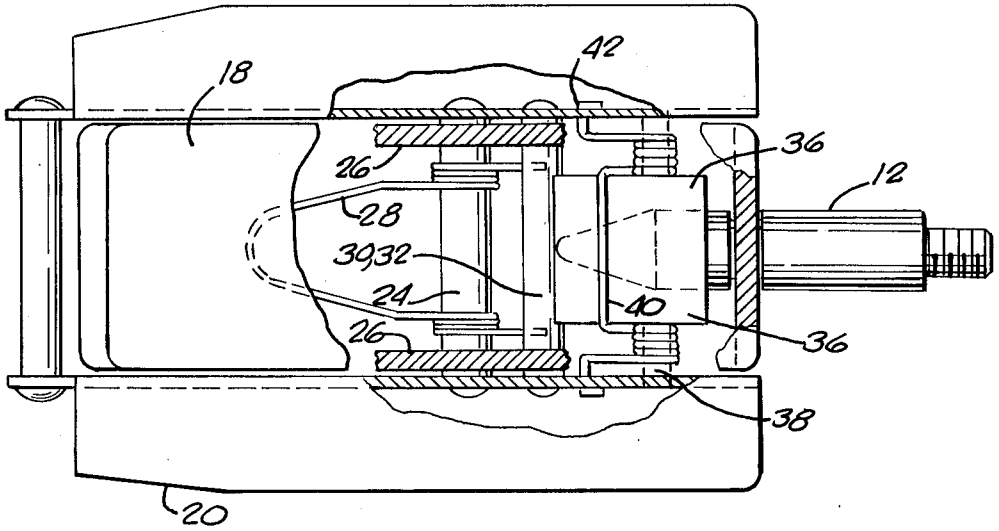
FIG. 4 is a plan view of a latch and pin with a section broken out for clarity.

With the latch mechanism in the unlatched position as shown in FIG. 1, the cam member 36 is oriented such that the first end portion extends toward and just short of a circular latching portion 35 of the handle member 18. As the pin 12 slides toward the handle member 18, it will enter through the latching portion 48 until it engages the first end portion 44 of the cam member 36. The end portion 44 of the cam member 36 is smoothly contoured to provide a smooth follower surface for the tip 14 of the pin 12. Further translation of the pin 12 causes the cam member 36 to rotate about the pin 38 until the second end portion 46 contacts the handle member 18 at the cam follower surface 29 thereof, thereby causing the handle member 18 to pivot about the handle support pin 24 as shown in FIG. 2. The pin 12 will continue to translate until the latching portion 15 thereof lines up with the engagement portion 35 of the handle member 18. At this point, the cam member 36 will have rotated so that the second end portion 46 thereof no longer displaces the handle member 18. The surfaces of the latching portion 15 and the engagement portion 35 being perpendicular to the axis of the latching pin 12, retraction or further insertion of the latching pin 12 is prevented without rotating the handle 18. The handle spring 28 will then bias the handle member 18 into its latched position as shown in FIG. 3. The force of the handle spring 28 is greater than that of the spring 40, thus overriding same. To unlatch the mechanism, the operator presses on the handle member 18 adjacent the end portion 34 thereof, thereby pivoting the handle member 18 into the unlatched position. As the pin 12 is removed, the cam member 36 will pivot under the force of the spring 40 back to its initial position with the end portion 44 thereof extending toward the latching portion 48 of the handle member 18.

Thus, a latch mechanism having a self-latching feature has been disclosed wherein an operator need only control the sliding of the pin in order to effect latching. While embodiments and applications of this invention have been shown and described, it would be apparent to those of ordinary skill in the art that many more modifications would be possible without departing from the inventive concept herein. Thus, the invention is not to be limited except in the spirit of the appended claims.

What is claimed is:

1. A mechanism for latching a first body and a second body, comprising a latching pin for disposition relative to the first body and having a latching portion and being associated with the first body;

a pivotable latching member for disposition relative to the second body having an engagement portion, said latching member being resiliently biased for engagement of said engagement portion with said latching portion of said latching pin, said latching pin being slidably engageable with said latching member; and a cam member pivotally mounted relative to the second body, said latching member having a cam follower surface engaged by said cam member, said cam member extending to intersect said latch pin upon slidable engagement with said latching member, said cam follower surface and said cam member being constructed and arranged to sequentially raise and release said latching member upon progressive slidable engagement of said latching pin with said latching member.

2. The mechanism of claim 1 wherein said engagement portion of said latching member and said latching portion of said latching pin each include engaging surfaces substantially perpendicular to the centerline of said pin to prevent camming disengagement of said latching member and said latching pin.

* * * * *